US006993408B2

(12) United States Patent
Puurtinen

(10) Patent No.: US 6,993,408 B2
(45) Date of Patent: Jan. 31, 2006

(54) METHOD FOR THE CONTROL OF QUALITY IN A PAPER WEB

(75) Inventor: Ari Puurtinen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 215 days.

(21) Appl. No.: 10/427,323

(22) Filed: May 1, 2003

(65) Prior Publication Data

US 2003/0216828 A1 Nov. 20, 2003

(30) Foreign Application Priority Data

May 3, 2002 (FI) ..... 20020839

(51) Int. Cl.
*G06F 7/66* (2006.01)

(52) U.S. Cl. ..... 700/128; 700/109; 700/127; 700/129; 162/198; 162/258

(58) Field of Classification Search ..... 700/108, 700/109, 127, 128, 129; 162/13, 100, 198, 162/252, 253, 258, 262
See application file for complete search history.

(56) References Cited

U.S. PATENT DOCUMENTS

| | | | | |
|---|---|---|---|---|
| 4,614,566 A * | 9/1986 | Koponen et al. | ..... | 162/301 |
| 5,812,404 A * | 9/1998 | Hamalainen et al. | ..... | 700/128 |
| 5,825,653 A | 10/1998 | Huovila et al. | | |
| 5,879,513 A | 3/1999 | Karvinen | | |
| 6,153,057 A * | 11/2000 | Aidun | ..... | 163/343 |
| 6,319,362 B1 * | 11/2001 | Huhtelin et al. | ..... | 700/128 |

* cited by examiner

*Primary Examiner*—Leo Picard
*Assistant Examiner*—Charles Kasenge
(74) *Attorney, Agent, or Firm*—Stiennon & Stiennon

(57) ABSTRACT

Paper quality is controlled in the production of a paper web, where paper stock is fed from the headbox of the paper machine onto the wire section, whereby the paper stock is formed into a paper web. The headbox flow rate and consistency are measured from the paper stock fed into the headbox, and the water quantities removed on the wire section during the formation of the paper web are measured on the wire section. In the method, a filler distribution model is established, into which data on the wire section geometry, measured headbox flow rate and consistency and on the water quantities removed on the wire section are entered, and the model is used for establishing an estimate of the filler distribution, and the running values of the paper machine are adjusted on the basis of the estimated filler distribution.

11 Claims, 2 Drawing Sheets

METHOD FOR THE CONTROL OF QUALITY IN A PAPER WEB

CROSS REFERENCES TO RELATED APPLICATIONS

This application claims priority on Finnish Application No. 20020839, filed May 3, 2002, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to methods for controlling paper quality in the production of a web of paper.

In prior art paper and board machines, the stock is fed from the headbox to the former, usually to a joint run between two wire loops, where water is removed from the web as symmetrically as possible through both wires. The objective is a web which is symmetrical in relation to the longitudinal center level of the web. From the former, i.e. from the wire section, the paper or board web is led to the press section, where more water is removed from the web, and then to the dryer section, after which the web is reeled on the reel and, if necessary, taken to finishing.

The production of paper and board webs conventionally begins in the headbox by preparing a stock, into which fiber material and fillers as well as fines and additives are mixed. The stock system mixes the fibers and fillers as well as the potential fines and additives into a stock which is as homogeneous as possible, the stock to be fed into the headbox of the paper or board machine. In multilayer webs, several separate stock systems are also used for feeding different fiber suspensions either into a single headbox or several headboxes. The headbox spreads the stock suspension evenly onto the wire section, where dewatering and web formation begin. There are several different types of prior art wire sections or formers: Fourdrinier formers, hybrid formers and gap formers. Board machines may have several wire units. In prior art solutions, it is possible to control the fiber and filler distribution in the thickness direction of the web in a limited manner only, for instance through the placement of dewatering elements on the former and through the use of vacuum. Fillers often accumulate on the web surfaces during the dewatering phases.

The control of filler distribution in the thickness direction of the paper web is a desirable feature in many senses. However, prior art solutions do not provide a simple and inexpensive solution for this. The need to control the filler distribution may be caused by factors such as a need to control the symmetry (absorption, roughness) between the surfaces of the paper web or by a need to control the surface properties of the base paper in coating carried out in conjunction with finishing, for instance. However, the conventional problem has been to identify the magnitudes and directions of variables influencing distribution control as well as the mutual interaction between various impacts. This control is further complicated by the fact that the simultaneous optimization of the various sub-variables of paper web quality does not succeed as desired, which means that compromises need to be used.

One of the problems of prior art solutions in on-line fine paper applications is that the on-line process does not give information on the filler distribution of the web, but information on the successfulness of the filler distribution is obtained after a delay of approximately one day, because the filler distribution can only be determined on the basis of analyses made of a complete web.

Prior art arrangements include the measurement of water quantities on the wire section, but information obtained in this way has not been utilized directly but it has primarily been used for gathering information and not as a basis for readjustments.

With regard to prior art solutions, reference is made to U.S. Pat. No. 5,825,653, which presents a control method for the wire section based on a flow model, where the wire section is controlled by means of flow calculation. In this known arrangement, a physical flow model is established, based on wire dewatering and on the flow state of the stock suspension so that wire dewatering is measured at several locations of the wire section by measuring the quantity of water removed at the different locations, and the flow state of the stock suspension is defined by means of the stock jet velocity, wire speed and stock consistency. Paper quality is monitored at the dry end of the paper machine. The model defines a target flow state and the difference between the current flow state and the target flow state, which gives a cost function which is used for defining new control and set values so that the target flow state could be reached. This known solution hence requires the creation of a physical flow model, which makes the method rather complicated and requires considerable know-how.

Prior art reference is also made to U.S. Pat. No.5,879,513, which presents a method and equipment for dewatering on the wire and/or press section of a paper machine or similar machine. In this known method, at least one suction pipe is equipped with at least one slot, and the suction pipe is connected to a vacuum source in order to create a vacuum in at least this suction pipe, and the felt, wire or similar fabric is transferred in this method over the slot in the suction pipe so that the vacuum removes water from the felt, wire or similar fabric. In this known method, at least the quantity of water removed in the suction pipe is measured, and the vacuum capacity is controlled on the basis of the measured information by means of control equipment.

SUMMARY OF THE INVENTION

However, neither of the above arrangements enables the control of filler distribution in the thickness direction of a paper or board web.

For this reason, the specific objective of the present invention is to create a method for the control of filler distribution in the thickness direction of a paper web.

Another objective of the present invention is to create a method for the control of paper web quality in an on-line environment especially with regard to the filler distribution.

Yet another objective of the present invention is to create a method where the paper material distribution is determined in order to achieve successful coating.

In accordance with the invention, model-based filler distribution control is used in the control of filler distribution, where the control variables of the headbox and former of a paper or board machine are utilized. The model describes the filler distribution by means of parameters estimated in the model. In the filler distribution model, the nature of the distribution is described using two parameters, a symmetry coefficient describing the symmetry of the distribution and a term describing the shape of the distribution, usually its likeness to the letter U. The model is used for estimating the magnitude and direction of the impact of parameters influencing the shape of the distribution and the mutual interaction of the parameters. The model is also used for determining a strategy for the optimized control of filler distribution. In this way, for instance the same filler distribution symmetry can be achieved through several combinations of different control variables. For instance, distributions defined from a complete fiber web in a laboratory are used as the control variable in distribution control and in the creation of the model, and the flow and consistency balance of waters removed from the former as well as the flow and consistency differences of these waters between the different sides of the web can also be used as the control variable. If necessary, it is possible to use a suitable on-line measurement, such as indirect brightness measurement, for the monitoring of differences between the different sides of paper and of the functionality of the model. The boundary values used in the model are the furnish, dewatering and potential ash consistency/flow rate consistency.

The model of the present invention only requires on-line measurement of water quantities removed on the wire section. The filler distribution is forecasted by means of the model on the basis of the measurement results. The consistency of removed waters can also be measured.

In accordance with a preferred embodiment of the invention, the total flow rate of the wire section is measured and the two-sidedness of paper is monitored, and these give sufficient information for filler distribution control.

In accordance with another preferred embodiment of the invention, the quantities of water removed are measured separately at roll dewatering locations and at blade dewatering locations, and the filler distribution is defined on the basis of these. In this conjunction, the impacts of stable dewatering (roll dewatering) and pulsating dewatering on the model are taken into account; these impacts have an effect on the shape of the filler distribution, especially on how much filler is located at the surfaces as compared to the center part of the web.

In accordance with the present invention, when moving over to new geometry on the wire section, the control variables of the new geometry are determined in order to define the model.

In accordance with the model, the following data are entered in the model: stock consistency, fiber composition, fillers, and results of water quantity measurements on the wire section with water quantities specified separately for both sides of the paper web so that information on the two-sidedness of dewatering is obtained. On the basis of the model, a filler distribution is drawn up, and the machine operator can use the filler distribution to adjust the running values so that a desired distribution is achieved. The operator can adjust various running values—such as flow rate in the dewatering equipment, vacuums applied, loading used in blade dewatering, or geometry—on the basis of the filler distribution drawn up by means of the model in order to achieve the desired filler distribution.

The solution of the present invention can be used very well in multi-layer webs, where the properties of stocks fed to the different layers of a multi-layer headbox and/or the quantities of fillers, fines and additives in these stocks can be adjusted on the basis of the distribution drawn up by virtue of the model.

BRIEF DESCRIPTION OF THE DRAWINGS

In the following, the invention is described in more detail with reference to the figures of the accompanying drawing, with the invention not being narrowly restricted to the details of the figures.

DESCRIPTION OF THE PREFERRED EMBODIMENTS

Figure 1:
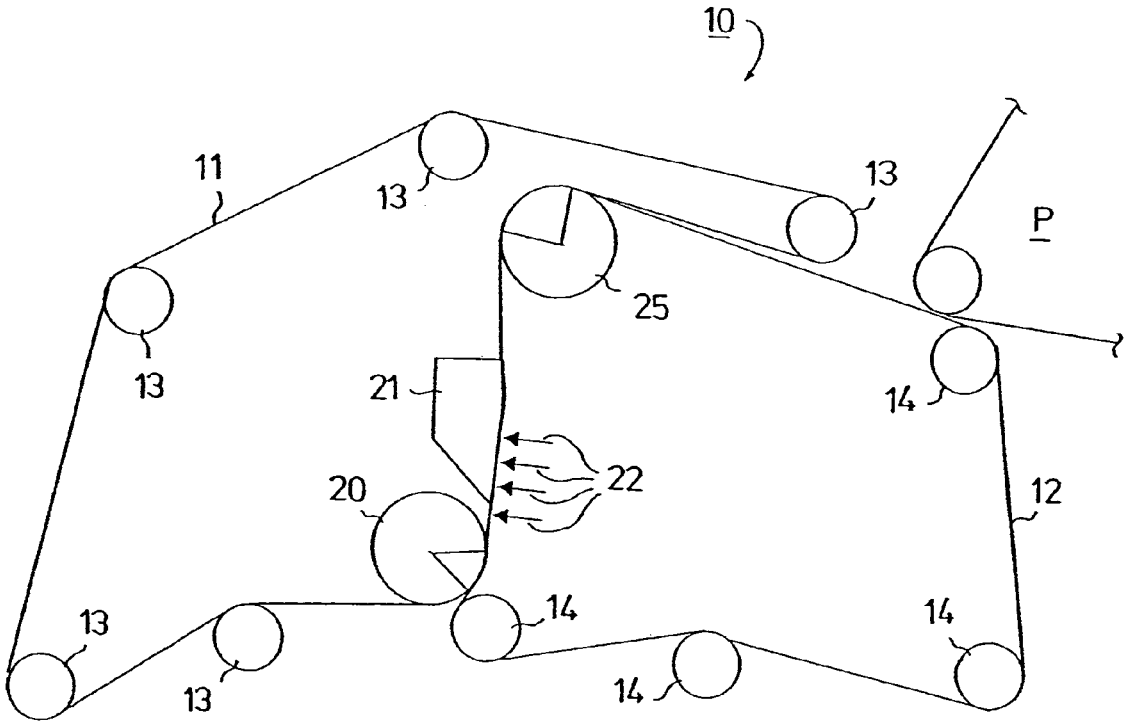
FIG. 1 is a schematic view of the former of a paper machine.

FIG. 1 is a schematic view of one example of the wire section 10 of a paper machine, where the example represents so-called gap formers, where the wire section is composed of two wire loops 11 and 12, and the slice jet emitted from the headbox (not presented) is run into the gap 15 between these wire loops. Both wire loops have their own return and guide rolls 13, 14, some of which may be movable, in which case the tensions of wires 11, 12 can be changed by means of these rolls. The slice jet coming from the headbox first meets the forming roll 20, after which there is a suction box 21, which is composed of several dewatering blades of prior art. The suction box 21 typically has several vacuum chambers so that the use of vacuum intensifies the pressure pulses. On the opposite side of the web, there are usually loadable blades 22, which in FIG. 1 are denoted with arrows; these blades promote dewatering by causing shear forces in the suspension located within the web, and these shear forces break up fiber flocks, thus improving web formation. The web is taken further from this dewatering phase accomplished by means of a suction box 21 and loadable blades 22 between wires 11, 12 to the couch roll 25, where more water can be removed from the web. After this, the web is taken to press section P on the surface of the latter wire loop 12.

Figure 2:
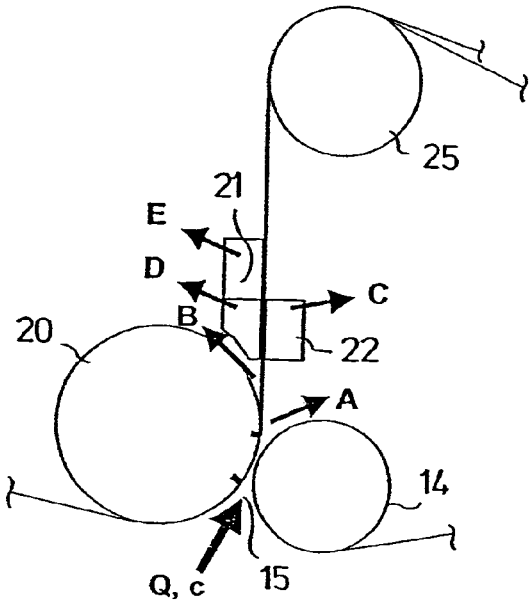
FIG. 2 is a schematic view of a former where the water quantity measurements to be carried out have been indicated.

FIG. 2 presents schematically points of dewatering measured in the arrangement of the invention. The same reference numbers have been used of the same parts in FIG. 1 and FIG. 2.

In accordance with FIG. 2, in one preferred embodiment of the invention, dewatering is measured as dewatering taking place on the forming roll 20 and within the blade area 21, 22. In order to determine the filler distribution, water quantity measurements A, B, C, D, E are carried out, and in order to determine the filler distribution model, information on the headbox flow rate Q and on headbox flow consistency c are also needed.

The letters shown in FIG. 2 indicate the dewatering measurement results needed in the determination of the filler distribution in accordance with the invention, and the headbox flow rate and headbox flow consistency are also indicated by letters. Below is a legend of the letters used in the figures:

Headbox flow rate=Q

Headbox flow consistency=c

Dewatering within the forming area=A+B+C+D+E

Two-sidedness of dewatering within the forming area=BS/TS=(A+C)/(B+D+E)

Roll dewatering=A+B

Two-sidedness of roll dewatering=BS/TS=A/B

Blade dewatering=C+D+E

Two-sidedness of blade dewatering=BS/TS=C/(D+E)

Bottom side of web=BS

Top side of web=TS

The above legend also shows how total dewatering, i.e. dewatering A+B+C+D+E within the entire forming area, roll dewatering A+B and blade dewatering C+D+E, is determined from the measurement results through calculations. It has also been presented how the dewatering measurement results are used to determine the two-sidedness of dewatering.

Figure 3:
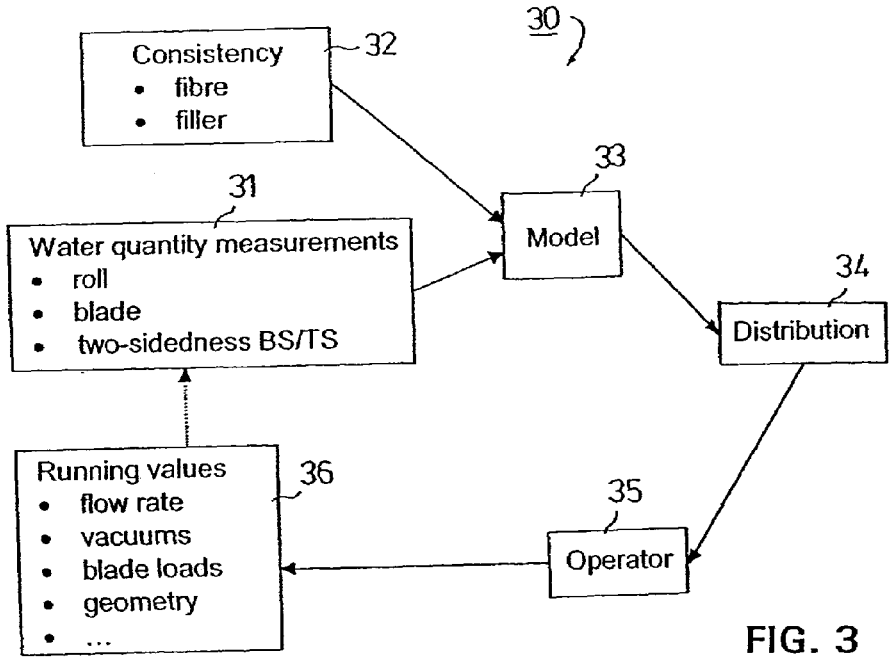
FIG. 3 is a block diagram of the use of the model of the present invention.
Figure 4:
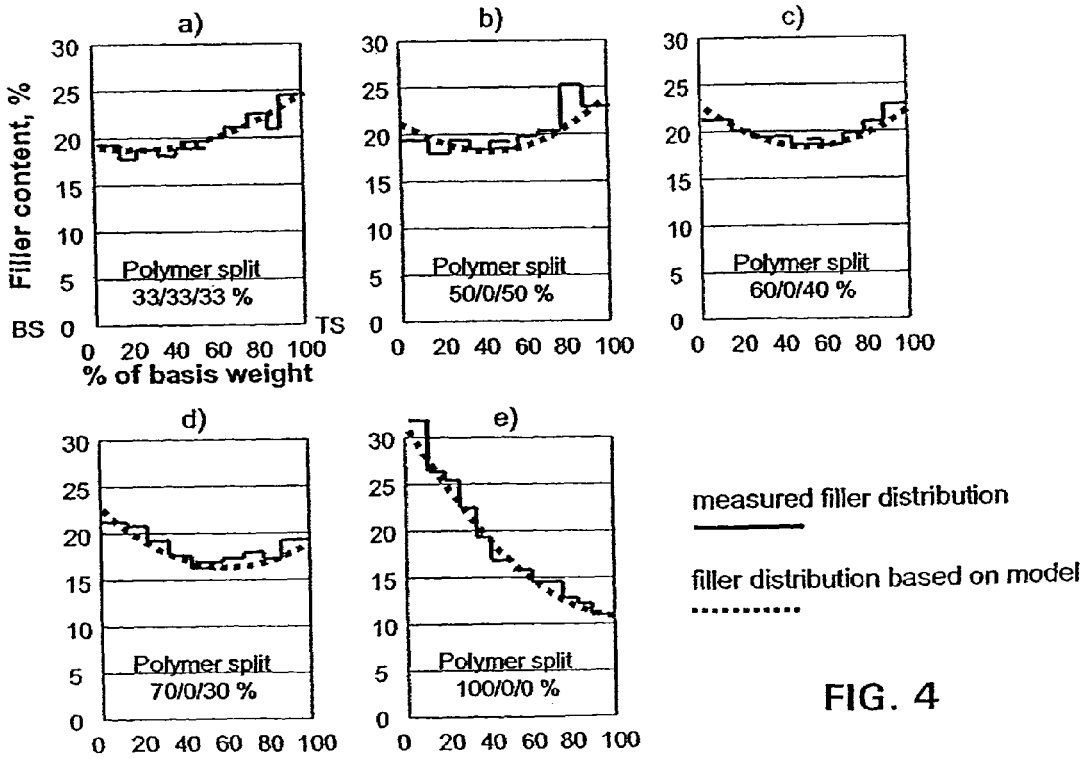
FIGS. 4*a*, 4*b*, 4*c*, 4*d*, 4*e* present schematic views of some results achieved through the model of the present invention as compared to the actual situation.

In accordance with FIG. 3, the measurement results obtained in the above schematic FIG. 2, block 31, are entered into system 30 of the invention, where the results obtained from the water quantity measurements 31 and consistency measurements 32 are entered into the model 33, on the basis of which the filler distribution 34 is determined. After this, the machine operator carries out the necessary adjustments in order to achieve the desired filler distribution by changing the running values 36, such as flow rate, vacuums, blade loads, geometry etc. in a suitable manner; for instance, raising the vacuum level on the forming roll will increase dewatering in the forming roll direction, and increasing the headbox flow rate will increase blade dewatering, after which the situation can be specified further by changing the running values on the basis of the distribution data obtained in the next phase.

The model of the invention is based on mathematical expressions of parameters describing the symmetry and shape of filler distribution:

Fsym=f(Pu, Psym, FRvac, LBvac, LBf, HBX, Q)

Fu=f(Pu, Psym, FRvac, LBvac, LBf, HBX, Q)

The expressions can also be presented by means of dewatering:

$$Fsym = f\left(A+B+C+D+E, \frac{A+C}{B+D+E}, A+B, \frac{A}{B}, C+D+E, \frac{C}{D+E}\right)$$

$$Fu = f\left(A+B+C+D+E, \frac{A+C}{B+D+E}, A+B, \frac{A}{B}, C+D+E, \frac{C}{D+E}\right)$$

where:

Psym=symmetry coefficient for polymer dosage

Pu=shape coefficient for polymer dosage

FRvac=vacuum of forming roll, kPa

HBX=headbox outlet geometry

LBvac=suction box vacuum

LBf=load force of loading elements

Q=headbox flow rate, 1/s*m

In the wire section, dewatering elements effect the shape of the filler distribution. Roll dewatering (non-pulsating dewatering) and blade dewatering (pulsating dewatering) create a different kind of filler distribution shape. Blade dewatering moves fillers more to the surface, so the shape is more U-shaped or "smiling" than roll dewatering.

For each dewatering element, water parameters are measured, that is, the white water amount, and white water consistency. Dewatering element position also affects filler distribution, mostly the symmetry of the distribution. Normally the desired result is that the white water be removed 50 percent through the top side of the web and 50 percent through the bottom side of the web, as this produces the most symmetric filler distribution. If the white water balance is not symmetrical, it affects the symmetry of the filler distribution. The dewatering balance is not the only factor controlling symmetry, the consistency of the white water removed from each side of the web and the dewatering element positions also affect symmetry. If the white water consistency is high from a particular dewatering element, then the filler content in the surface of the web adjacent the dewatering element is also high and vice versa.

Headbox flow rate and consistency is important to know, because that information is needed for comparing headbox flow rate to the white water amount removed from the wire section. Headbox consistency is compared to the white water consistency removed from the wire section. Headbox flow rate and consistency provides the solids content that is fed to the wire section. Headbox flow rate and consistency affects the symmetry and the shape of the filler distribution.

The model used for predicting the filler distribution in the thickness direction of the paper web is machine dependent. However, a model can be built based on the foregoing parameters and the general understanding known to those in the art of the different types of effects which the different dewatering devices produce.

Paper web filler distribution is typically measured by dividing the paper web into 10 equally spaced samples in the thickness direction and measuring filler content in each sample. In most cases it is desirable that the filler distribution be symmetrical with respect to the center of the paper. Normally one of three distribution patterns is sought, an even distribution where the amount of filler is evenly distributed across the thickness of the web, this is a so-called "flat" distribution. Alternatively, if more filler is retained at the surfaces of the paper web a so-called "smiling" or U-shaped distribution is obtained. On the other hand, if more filler is retained in the center of the paper web and less on the surfaces, a so-called "sad" distribution is produced.

The purpose of using a model to predict the filler distribution is that normally it takes one day to obtain results from tests on the filler distribution performed on the finished paper. Therefore, it is difficult to adjust the machine in order to achieve the desired filler distribution. A model which can relate parameters such as the amount of vacuum applied to various dewatering devices to the resulting filler distribution allows adjustments of parameters in real-time to achieve the desired filler profile for a particular paper web.

However during development and perhaps periodically, feedback is provided through testing of the paper web. Thus the model will normally be implemented by a person with experience in the design of control systems, having, or working with a person having, knowledge of the papermaking process.

FIGS. 4*a*–4*e* present filler distributions measured in a multi-layer web (solid line) and the filler distribution obtained by means of the model of the invention (dotted line). The vertical axis shows the filler content and the horizontal axis the percentual weight. The filler distribution used in each layer has been indicated in conjunction with each figure. In other words, FIGS. 4*a*–4*e* present examples of the suitability of the filler distribution model to a series run on a pilot machine, where the variable in the series was the retention chemical distribution in the thickness direction of the paper.

As can be seen in FIGS. 4*a*–4*e*, the model of the invention gives very good results, which describe well the actual filler distribution.

In this invention, paper web also refers to a board web.

I claim:

1. A Method for the control of quality in a paper web in the production of a paper web, of the type where paper stock is fed from the headbox of the paper machine onto a wire section, whereby the paper stock is formed into a paper web and where the headbox flow rate and consistency are measured from the paper stock fed into the headbox and where the water quantities removed on the wire section during the formation of the paper web are measured on the wire section, the improvement comprising:

a filler distribution model into which data on the wire section geometry, measured headbox flow rate and consistency, and on the water quantities removed on the wire section are entered, and wherein the model is used for establishing an estimate of the filler distribution and where the running values of the paper machine are adjusted by means of the estimated filler distribution.

2. The method of claim 1, wherein the water quantities removed on the wire section are measured at roll dewatering locations and at blade dewatering locations and wherein the two-sidedness of dewatering is determined on the basis of the measurement results and wherein the two-sidedness determined is entered in the model.

3. A Method for the control of quality in a paper web in the production of a paper web, of the type where paper stock is fed from the headbox of the paper machine onto a wire section, whereby the paper stock is formed into a paper web and where the headbox flow rate and consistency are measured from the paper stock fed into the headbox and where the water quantities removed on the wire section during the formation of the paper web are measured on the wire section, the improvement comprising:

a filler distribution model into which data on the wire section geometry, measured headbox flow rate and consistency, and on the water quantities removed on the wire section are entered, and wherein the model is used for establishing an estimate of the filler distribution and where the running values of the paper machine are adjusted by means of the estimated filler distribution, wherein the model is based on mathematical expressions of parameters describing the symmetry and shape of filler distribution:

$$Fsym=f(Pu, Psym, FRvac, LBvac, LBf, HBX, Q)$$

$$Fu=f(Pu, Psym, FRvac, LBvac, LBf, HBX, Q)$$

where:

Psym=symmetry coefficient for polymer dosage
Pu=shape coefficient for polymer dosage
FRvac=vacuum of forming roll, kPa
HBX=headbox outlet geometry
LBvac=suction box vacuum
LBf=load force of loading elements
Q=headbox flow rate, l/s*m.

4. The method of claim 1, wherein the filler distribution estimate obtained by means of the model is used for controlling the running values of the paper machine to achieve successful coating.

5. The method of claim 1, wherein boundary values used in the model are the furnish used in the fiber web machine, dewatering on the wire section, and headbox ash consistency/flow rate consistency.

6. The method of claim 1, wherein an operator adjusts the headbox flow rate, vacuums applied in the dewatering equipment, loading used in blade dewatering, and/or wire section geometry based on the model.

7. The method of claim 1, wherein the quantity of a material chosen from the group consisting of: fillers, fines, and additives which is fed to different layers of a multi-layer headbox is adjusted on the basis of the filler distribution estimate obtained from the model.

8. A Method for the control of quality in a paper web in the production of a paper web, comprising the steps of feeding paper stock from a headbox of a paper machine onto a wire section, whereby the paper stock is formed into a paper web;

measuring headhox flow rate;

measuring headbox consistency;

measuring quantities of water removed on the wire section;

entering the measured headbox flow rate, headbox consistency, and quantities of water removed on the wire section, and data on the wire section geometry, into a filler distribution model;

using the filler distribution model to establish an estimate of the filler distribution in the thickness direction of the web; and adjusting the running values of the paper machine based on the estimate.

9. The method of claim 8, wherein the step of measuring water quantities removed on the wire section includes the steps of measuring water quantities removed at roll dewatering locations and at blade dewatering locations, and wherein the two-sidedness of dewatering is determined on the basis of the measurement results and wherein the two-sidedness determined is entered in the model.

10. The method of claim 8, wherein the step of adjusting the running values of the paper machine based on the estimate comprises the steps of adjusting headbox flow rate;

adjusting vacuums applied in the dewatering equipment; and adjusting loading used in blade dewatering, and/or wire section geometry based on the model.

11. The method of claim 8, wherein the quantity of a material chosen from the group consisting of: fillers, fines, and additives which is fed to different layers of a multi-layer headbox is adjusted on the basis of the estimate.

* * * * *